US005230372A

United States Patent [19]

Westphal

[11] Patent Number: 5,230,372

[45] Date of Patent: Jul. 27, 1993

[54] FUEL OVERFILL RECOVERY SYSTEM

[76] Inventor: H. Frederick Westphal, 621 Bayside Dr., Newport Beach, Calif. 92660

[21] Appl. No.: 844,525

[22] Filed: Mar. 2, 1992

[51] Int. Cl.[5] ..... B65B 3/04; B63B 17/00

[52] U.S. Cl. ..... 141/86; 114/343; 141/311 A; 141/95; 141/331

[58] Field of Search ..... 141/86, 88, 311 A, 331, 141/95; 114/343

[56] References Cited

U.S. PATENT DOCUMENTS

| | | | |
|---|---|---|---|
| 2,555,868 | 6/1951 | Bowman | 141/86 |
| 3,734,149 | 5/1973 | Hansel | 141/95 X |
| 3,825,042 | 7/1974 | Glantz | 141/95 |
| 3,967,660 | 7/1976 | Russell | 141/95 |
| 4,013,105 | 3/1977 | Uuskallio | 141/86 |
| 4,053,002 | 10/1977 | Ludlow | 141/95 |
| 4,082,125 | 4/1978 | Wilson et al. | 141/86 |
| 4,782,667 | 11/1988 | Kito et al. | 141/86 X |
| 4,802,514 | 2/1989 | Morse | 141/86 |
| 5,070,806 | 12/1991 | Coster | 114/343 |

*Primary Examiner*—Ernest G. Cusick
*Attorney, Agent, or Firm*—Edgar W. Averill, Jr.

[57] ABSTRACT

A fuel overfill recovery system for use on marine craft of the type having a fuel vent fitting extending outwardly from the hull of the craft. The fuel overfill recovery system has a diverter body which is placed over the fuel vent fitting during refueling of the craft. As the fuel tank of the craft becomes full, excess fuel which otherwise would exit the fuel vent fitting and fall onto the surface of the waterway is collected by a diverter body and passed into a fuel collection container.

9 Claims, 2 Drawing Sheets

FUEL TANK
13
10
11
12
14
19
31
40
41
42
43
44
45
46
50
51
5

FUEL OVERFILL RECOVERY SYSTEM

BACKGROUND OF THE INVENTION

The field of the invention is marine accessories, and the invention relates more particularly to accessories for preventing fuel from spilling into the water during refueling. Motorized marine craft typically employ one or more internally mounted fuel tanks to provide fuel for engines aboard such as a propulsion engine or engines, electrical generators, and the like. The filling of the fuel tank, or tanks, is accomplished through a filler neck which typically includes internal threads. A fuel cap is securely held by the threads and is typically provided with a gasket which prevents water from entering the fuel tank around the filler cap and fuel from escaping. Thus, unlike the typical automobile which has a vented filler cap, the typical marine craft has an unvented cap, and the vent for the fuel tank, or tanks, is provided through a separate vent line which has a fuel vent fitting outside of the hull below the sheer.

The fuel vent fitting of choice is fabricated from brass and chrome plated. It includes a blind vent passageway having external threads in the middle thereof and having a fuel hose fitting at one end and an enlarged vent portion with a cylindrical exterior wall and a pair of screened vent outlets which are directed downwardly so that they do not tend to take on any water.

When the fuel tank is being filled at a marine service station, the filler cap is removed from the fuel inlet line, and the filling nozzle inserted into the inlet line. During the filling process, the entering fuel drops to the level in the tank and in impacting the fuel in the tank develops a layer of foam. Because there is no way for the operator filling the tank to determine the level of the fuel, ultimately this foam is expelled through either the filler neck or the vent fitting, or both. The result is an unintentional overboard discharge onto the dock or into the waterway. In marine craft on a waterway, this creates a very serious pollution problem. Although current law prohibits the creation of a visible sheen on waterways, there is presently no way of absolutely preventing this indication of a fuel spill.

SUMMARY OF THE INVENTION

It is an object of the present invention to provide a system for venting the unintentional spill of fuel onto waterways during the fueling of marine craft.

The present invention is for a fuel overfill recovery system for use on marine craft of the type having a vent line extending from the fuel tank terminating in a fuel vent fitting. The system includes a diverter body with a cylindrical opening which is placed over the fuel vent fitting which extends outwardly from the hull of the marine craft. The diverter body is sealed to the exterior of the fuel vent fitting and has a fuel passageway which leads to a tube which, in turn, directs fuel to a collection reservoir. A sight glass assembly is also included which helps provide a visual indication of fuel overflow from the filler neck.

DESCRIPTION OF THE PREFERRED EMBODIMENTS

Figures 1, 2:
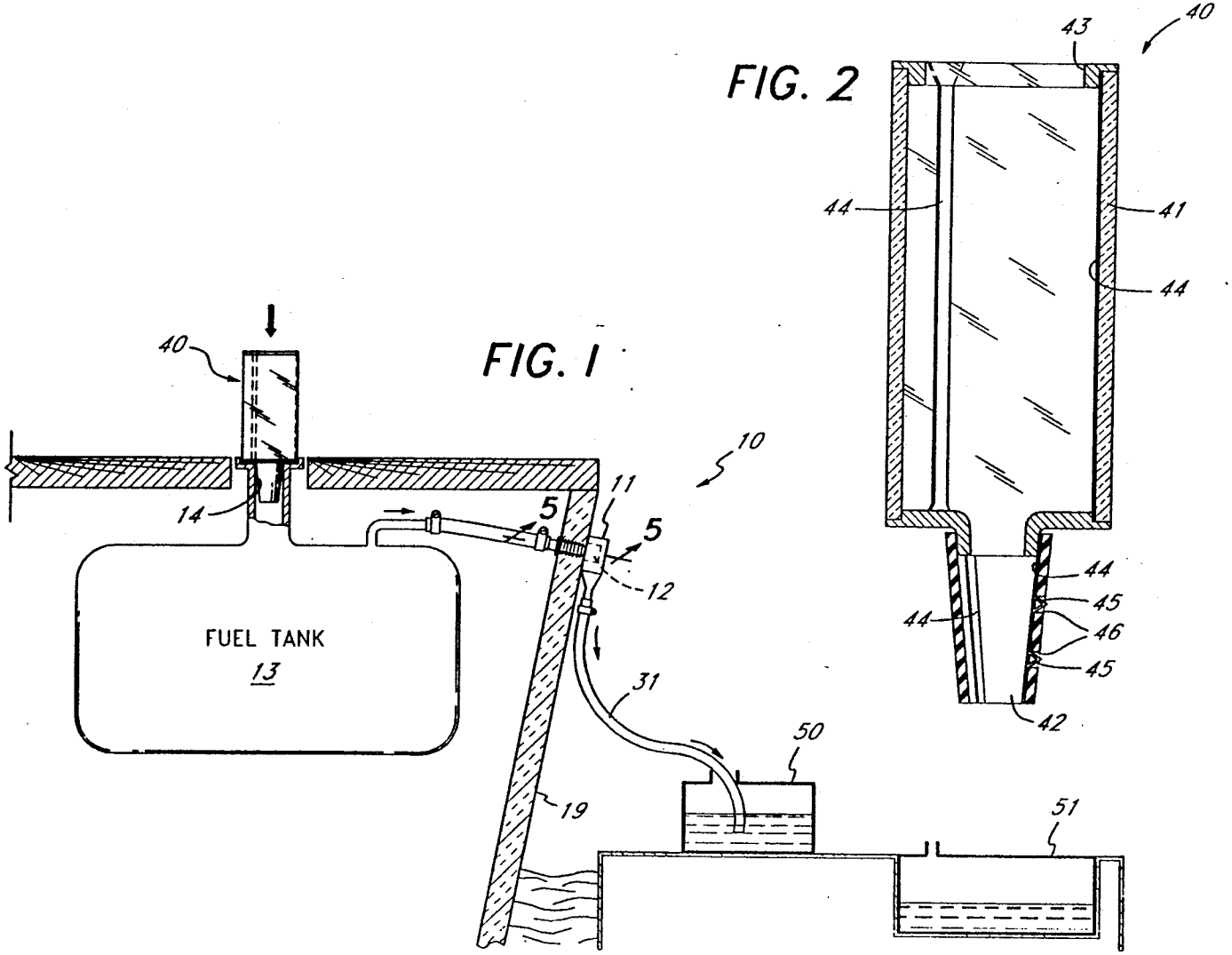
FIG. 1 is a diagrammatic view of the fuel overfill recovery system of the present invention.
FIG. 2 is an enlarged cross-sectional view of the sight glass assembly of the fuel overfill recovery system of the present invention.

The fuel overfill recovery system of the present invention is shown in FIG. 1 and indicated generally by reference character 10. The fuel recovery system has a diverter body 11 which is affixed over a fuel vent fitting 12. The fuel tank 13 has a fuel filler inlet 14 which is internally threaded.

In the typical fueling of a watercraft, the fuel nozzle is placed in fuel filler inlet 14 and fuel tank 13 filled until fuel splashes out of fuel vent fitting 12 which is typically lower than the fuel filler inlet 14. The very spilling of fuel through the fuel vent fitting is the method used to determine that the tank is filled. In busy waterways, the amount of fuel so spilled is significant and should be prevented.

Figure 5:
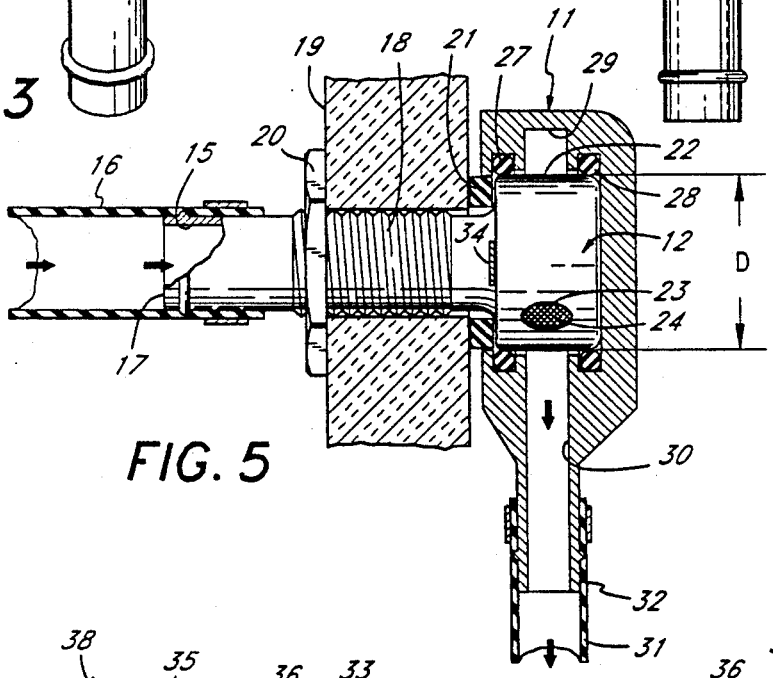
FIG. 5 is a cross-sectional side view taken along line 5—5 of FIG. 1.

The system of the present invention prevents such overflow from the fuel vent fitting by providing a diverter body which is sealed over the fuel vent fitting as shown best in FIG. 5 of the drawings. The typical fuel vent fitting is a chrome-plated brass fitting having a blind central vent passageway 15, a vent line, or hose, 16 is clamped at the inlet end 17 of fitting 12, and the exterior of the blind central vent passageway 15 is threaded at 18 so that the fitting may be held to the hull 19 by nut 20. A rubber washer 21 prevents leakage around passageway 15, and an enlarged cylindrical exterior wall 22 has two vent ports 23 which include a fine, fire blocking screen 24 which also reduces the tendency of water, insects or other debris from entering passageway 15.

Figure 3:
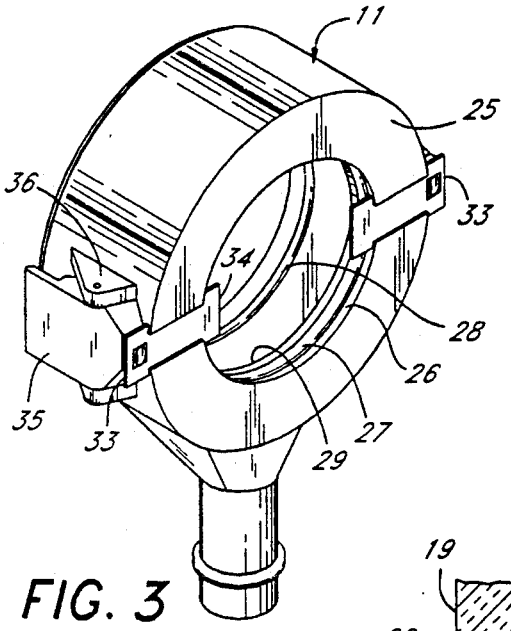
FIG. 3 is a perspective view showing the inner surface of the diverter body of the fuel overfill recovery system of FIG. 1.

The diverter body 11 is shown in perspective view in FIG. 3 and has a hull facing surface 25 from which a cylindrical blind opening 26 is formed. An 0-ring 27 provides a seal against the cylindrical exterior wall 22 of diverter body 11 as shown best in FIG. 5. An inner 0-ring 28 helps position the diverter body as also indicated in FIG. 5. An enlarged recess 29 provides a manifold for any fuel exiting the vent ports 23 and leads to a fuel outlet passageway 30 at the bottom of the diverter body. A flexible hose 31 is clamped, or otherwise affixed, to the exit fitting portion 32 of the outlet passageway 30. Hose 31 may be led either to a fuel collection container 50 or to a fuel recovery tank 51 provided at the watercraft service area. Fuel collection container 50 should also be transparent or translucent so that the operator can determine the level of fuel in it. Hose 31 also can be made from a transparent or translucent material to further indicate the first overflow of fuel which is collected by diverter body 11. It is also possible to provide an audible alarm when any fuel enters fuel collection container 50 to further prevent any spilling.

Figure 4:
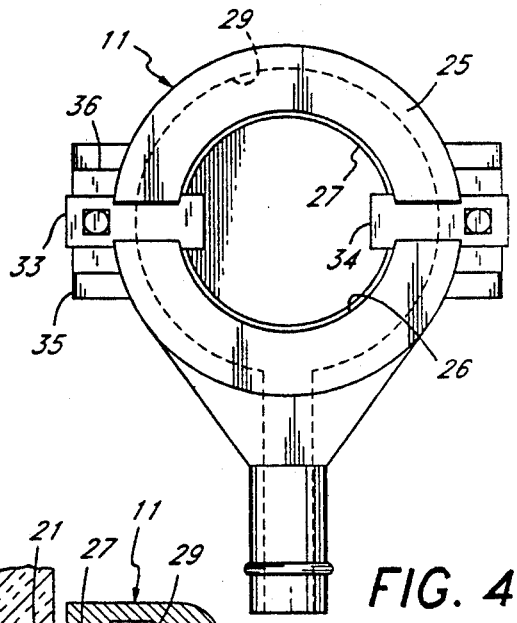
FIG. 4 is a rear view of the diverter body of FIG. 3.
Figure 6:
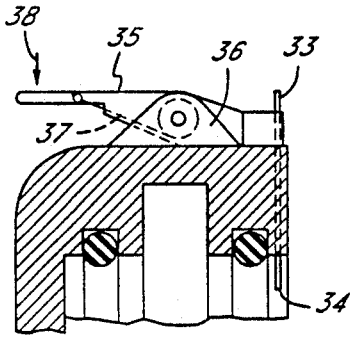
FIG. 6 is an enlarged cross-sectional view of the clip portion of the diverter body of FIG. 3 in a closed position.
Figure 7:
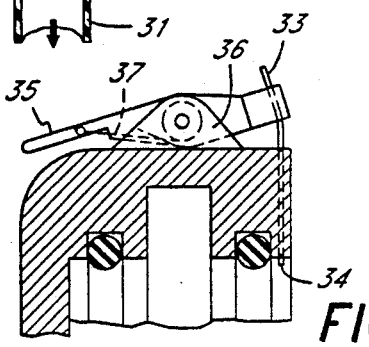
FIG. 7 is a cross-sectional view of the clip portion of the diverter body of FIG. 3 in an open configuration.

It is beneficial to have some means of securing the diverter body to the fuel vent fitting 12, and a pair of guillotine clips are provided as shown best in FIGS. 6 and 7 of the drawings. A clip portion 33 has a tip 34 which passes over the inner edge of the cylindrical exterior wall 22 as shown in phantom view in FIG. 5. A rocker member 35 is supported by a pair of ears 36 to the side of diverter body 11 as shown best in FIG. 3 of the drawings. Rocker member 35 is spring-loaded in a closed position by spring 37 as shown in FIG. 5. When rocker member 35 is pushed downwardly at arrow 38, as shown in FIG. 5, it lifts tip 34 out of contact with the fuel vent fitting 12. As shown best in FIG. 4, a pair of opposed rocker members and tips is provided so that diverter body 11 can be easily removed by squeezing the opposed rocker members thereby freeing it from contact with the fuel vent fitting 12. The tip 34 is shown in phantom view in FIG. 5.

Another source of both pollution and hazard is the fuel which flows out of the fuel filler inlet during the fueling operation. This is prevented by the addition of a sight glass assembly 40 shown in enlarged cross-sectional view in FIG. 2. Sight glass assembly 40 has a transparent wall portion 41 and an adaptive plug outlet or boot 42 which may be inserted into the threaded portion of the fuel filler inlet 14. A sight glass fuel inlet 43 is affixed to the transparent wall portion 41, and a grounding strap 44 connects the outlet 42 to the sight glass fuel inlet 43. Sight glass fuel inlet 43 is preferably fabricated from a conductive material and electrically connected to grounding strap 44. A plurality of spring-loaded contact points 45 extend through openings 46 in the side of boot 42. These contact the interior of filler inlet 14 to complete the ground path to sight glass fuel inlet 43. By adding sight glass assembly 40, the fuel or foam which splashes out of the filler inlet is easily collected and flows out of outlet 42 into fuel tank 13. After filling, the sight glass assembly 40 is removed, and the fuel cap (not shown) is secured onto the fuel filler inlet 14.

The fuel overfill recovery system of the present invention provides an easy-to-use method for preventing gasoline, diesel oil or other fuel from polluting waterways. It may be easily affixed, and its use will not only prevent pollution, but also provide a safer fueling environment.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A fuel overfill recovery system for use on marine craft of the type having a vent line extending from the fuel tank terminating in a fuel vent fitting having an outlet on the hull or other exterior surface of the craft, said fuel vent fitting being of the type having a blind central vent passageway surrounded near the end thereof by a cylindrical exterior wall having an outside diameter with one or more vent ports extending through the exterior wall to the central vent passageway, said system comprising:

a diverter body having a hull facing surface;

a cylindrical opening formed inwardly from said hull facing surface;

an enlarged recess surrounding said cylindrical opening;

sealing means within said cylindrical opening for sealing the diverter body to the cylindrical exterior wall of said fuel vent fitting;

a fuel outlet passageway leading from said enlarged recess said fuel outlet passageway including an exit fitting; and hose means leading from said exit fitting.

2. The fuel overfill recovery system of claim 1 further including means for holding said diverter body securely to said fuel vent fitting.

3. The fuel overfill recovery system of claim 2 wherein said means for holding said diverter body securely to said fuel vent fitting comprises at least one spring-loaded latch assembly positioned adjacent said hull facing surface, said at least one spring-loaded latch assembly having a latch arm having a tip which extends into said cylindrical opening and abuts said cylindrical exterior wall of said diverter body.

4. The fuel overfill recovery system of claim 3 wherein there are a pair of opposed spring-loaded latch assemblies.

5. The fuel overfill recovery system of claim 1 further including a translucent fuel collection container to collect fuel passing out of said hose means.

6. The fuel overfill recovery system of claim 1 further including sight glass assembly for insertion into a fuel filler inlet, said sight glass assembly having a sight glass outlet for affixing to said fuel filler inlet and said sight glass assembly extending upwardly from said fuel filler inlet and including a transparent wall portion extending upwardly from said fuel inlet opening and terminating in a sight glass fuel inlet and said sight glass assembly including a grounding strap extending from said sight glass outlet to said sight glass fuel inlet.

7. The fuel overfill recovery system of claim 6 wherein said sight glass outlet is a flexible boot.

8. The fuel overfill recovery system of claim 7 wherein said flexible boot has at least one opening for electrical contact to be made to said grounding strap.

9. The fuel overfill recovery system of claim 6 wherein said sight glass has a conductive ring at the sight glass inlet, and said conductive ring is in electrical contact with said grounding strap.

* * * * *